US008872670B2

(12) United States Patent
Jeffryes

(10) Patent No.: US 8,872,670 B2
(45) Date of Patent: Oct. 28, 2014

(54) COMPLIANCE TELEMETRY

(75) Inventor: Benjamin Peter Jeffryes, Cambridgeshire (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 1753 days.

(21) Appl. No.: 11/690,476

(22) Filed: Mar. 23, 2007

(65) Prior Publication Data

US 2008/0231467 A1 Sep. 25, 2008

(51) Int. Cl.

| | |
|---|---|
| ***G01V 3/00*** | (2006.01) |
| ***E21B 47/16*** | (2006.01) |
| ***E21B 47/18*** | (2012.01) |
| ***E21B 47/12*** | (2012.01) |

(52) U.S. Cl.
CPC ..... *E21B 47/12* (2013.01)
USPC ..... 340/854.3; 367/82; 367/83

(58) Field of Classification Search
None
See application file for complete search history.

(56) References Cited

U.S. PATENT DOCUMENTS

| | | | | | |
|---|---|---|---|---|---|
| 3,648,783 | A * | 3/1972 | Lackey | 173/4 |
| 3,813,656 | A * | 5/1974 | Fowler | 367/82 |
| 3,845,837 | A * | 11/1974 | McEvers et al. | 181/106 |
| 4,184,545 | A * | 1/1980 | Claycomb | 166/113 |
| 4,351,037 | A * | 9/1982 | Scherbatskoy | 367/85 |
| 4,593,559 | A * | 6/1986 | Brown et al. | 340/855.6 |
| 4,628,495 | A * | 12/1986 | Peppers et al. | 367/85 |
| 4,630,244 | A * | 12/1986 | Larronde | 367/84 |
| 4,635,718 | A * | 1/1987 | Thomas | 166/254.2 |
| 4,815,557 | A * | 3/1989 | Duwe | 181/106 |
| 4,828,051 | A * | 5/1989 | Titchener et al. | 340/855.2 |
| 5,319,610 | A * | 6/1994 | Airhart | 367/82 |
| 5,602,541 | A * | 2/1997 | Comeau et al. | 340/853.3 |
| 2007/0030762 | A1 * | 2/2007 | Huang et al. | 367/83 |
| 2008/0068929 | A1 * | 3/2008 | Hahn et al. | 367/84 |

FOREIGN PATENT DOCUMENTS

WO WO2005024182 * 3/2005

* cited by examiner

*Primary Examiner* — Mohammad Ghayour
*Assistant Examiner* — Jerold Murphy

(57) ABSTRACT

A communication system for communicating information with a compliant medium is disclosed, the communication device includes a constrained fluid, a valve, a modulator, a sensor and a demodulator. The constrained is fluid distributed along a length. The valve is configured to operatively engage a second point relative to the length. The modulator configured to actuate the valve according to information. The sensor configured to measure pressure at a first point relative to the length, where the first point is distant from the second point. The demodulator is coupled to the sensor to recover the information.

11 Claims, 10 Drawing Sheets

COMPLIANCE TELEMETRY

BACKGROUND

This disclosure relates in general to data communications and, but not by way of limitation, to communication using a compliant medium.

Electronic communication takes place wirelessly using radio frequencies, optically using light and with wires using electron flow. Often these communication mechanisms are not practical in certain applications. For example, wires are difficult to string along pipelines and down a bore hole. Equipment needs to communicate information despite limitations on available communications medium.

There are systems for down hole communication using pressure in a hydraulic line. The pressure in the hydraulic line is modulated by the pump with data to communicate with sub-surface devices that have no other communication medium available. Over time, the pressure can be increased and decreased to send information. These systems only communicate away from the pump.

Other systems use acoustic waves to communicate. An acoustic wave is produced and a gate may be inserted and removed to modulate the reflection of the acoustic wave. These systems require a generally direct path from the acoustic source back to the sensor registering the reflection. Heavily damped systems are not appropriate candidates for these systems.

On occasion, drillstrings can become snagged somewhere down hole. To determine the location of the snag, tension is put on the drillstring. A point of the drillstring is marked. Tension is increased and the distance the mark moves is measured. The distance and the differential in tension can be used to determine how far down the drillstring the snag occurs.

SUMMARY

In one embodiment, the present disclosure provides a communication system for communicating information with a compliant medium is disclosed. The communication device includes a constrained fluid, a valve, a modulator, a sensor and a demodulator. The constrained is fluid distributed along a length. The valve is configured to operatively engage a second point relative to the length. The modulator configured to actuate the valve according to information. The sensor configured to measure pressure at a first point relative to the length, where the first point is distant from the second point. The demodulator is coupled to the sensor to recover the information.

In another embodiment, the present disclosure provides a communication system for communicating information with a compliant medium. In one step, a compliant medium has a first point and a second point, where the first point is distant from the second point. A compliance damper is configured to operatively engage the second point. A modulator is configured to actuate the compliance damper according to information. A sensor configured to measure compliance of the compliant medium at the first point. A demodulator is configured to operatively engage the first point to recover the information.

In yet another embodiment, the present disclosure provides a communication system for communicating information with a compliant medium. In one step, a compliant medium includes a first point and a second point, where the first point is distant from the second point. A compliance damper is configured to operatively engage the second point. A modulator is configured to actuate the compliance damper according to information. A sensor configured to measure compliance of the compliant medium at the first point. The demodulator configured to operatively engage the first point to recover the information.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the appended figures.

Figure 1A:
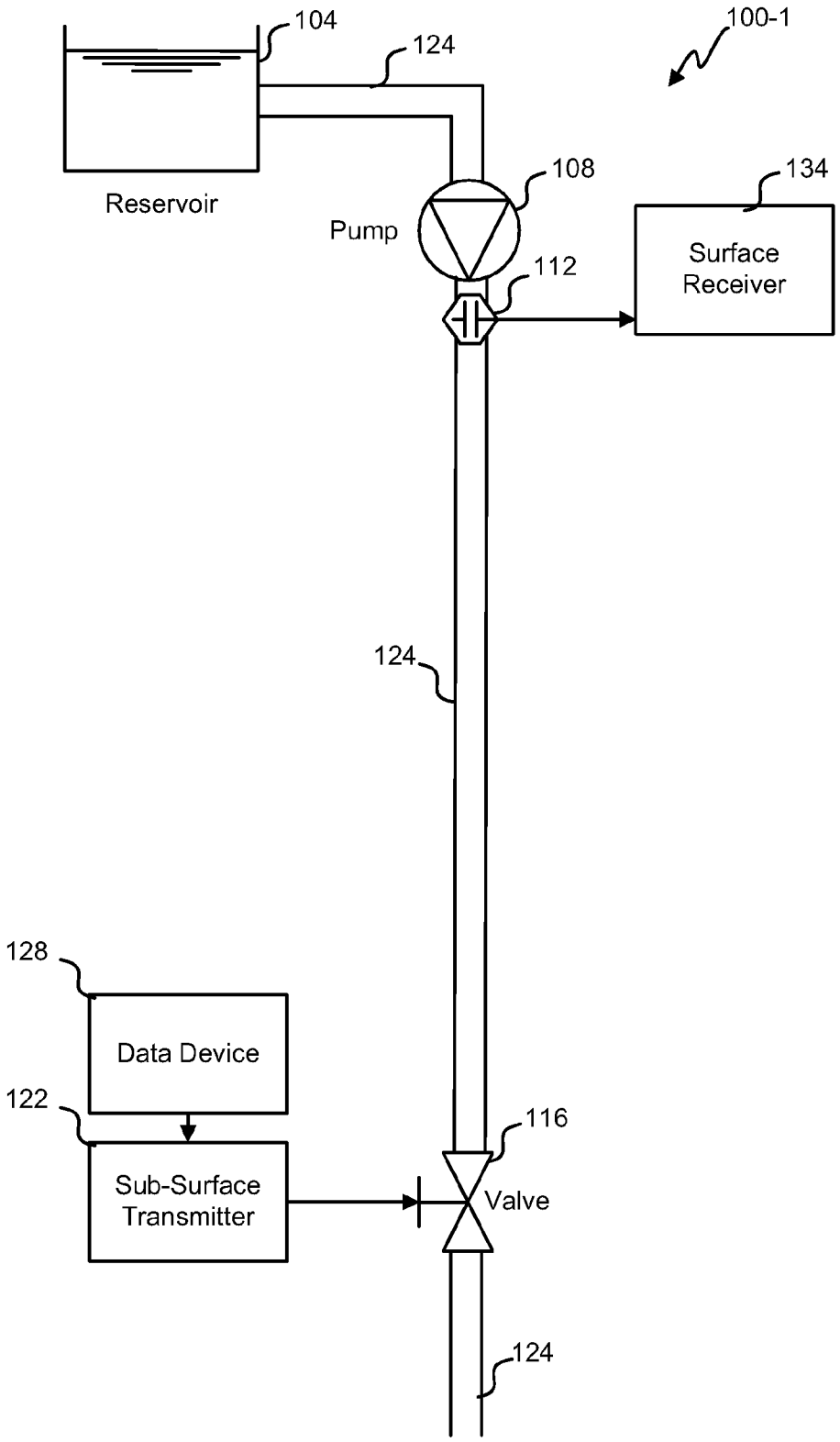
FIGS. 1A through 1E depict block diagrams of embodiments of a compliant communication system.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the disclosure. Rather, the ensuing description of the preferred exemplary embodiment (s) will provide those skilled in the art with an enabling description for implementing a preferred exemplary embodiment. It being understood that various changes may be made in the function and arrangement of elements without departing from the spirit and scope as set forth in the appended claims.

In one embodiment, a compliant communication system has sensors that are distributed along a compliant medium (e.g., a tank, a pipe, a hydraulic line, or a wire). Sparse data is transmitted at low power levels for applications such as telemetry. Above-ground equipment continuously applies a displacement to one part of the compliant medium to provide a bias (e.g., pumping or extracting fluid for the hydraulics, or pulling or releasing tension for the wire), and measures the rate of change of force (e.g., pressure or tension) as flow rate or displacement. Pinching (e.g., valves or grippers) along the compliant medium can actively isolate or connect the section of line below the sensor from the section above. The rate of change of force is inversely proportional to the compliance of the system above the pinching mechanism. By modulating the isolation and reconnection of the line above and below the sensor, data may be communicated from a sub-surface to a surface receiver by continuously measuring the observed compliance at the surface. In one embodiment, modulation of the bias communicates information to the sub-surface devices coupled to the compliant medium.

Data from downhole production gauges and sensors may be desired over the lifetime of a well, but only using a very low data rate to communicate information. Hourly, daily or even weekly data may be all that is required to monitor the performance of a well, for example. In some embodiments, there may be a limited amount of stored energy available downhole, without such limits above ground. When fluid is added to (or withdrawn from) the hydraulic line the pressure will rise (respectively fall). For a uniform line, the rate of rise (respectively fall) is inversely proportional to the length of line, so signals can be transmitted by varying the length of the line using valves.

The power required for to transmit data can be very low, especially if valve operations only take place when the hydraulic line pressure is at one preset value as is the case in one embodiment. The compliant system can be used to communicate with a device at the end of a hydraulic line by deploying a hydraulic reservoir beyond the device—effectively lengthening the line.

The data rate can be variable between embodiments or for one embodiment. Viscous effects of the compliant media define a characteristic time for the system. In one embodiment, the time taken to transmit one bit is a multiple of the characteristic time. Multiple transmitters may use the same compliant medium by use of time division, different data rates, etc.

Referring first to FIG. 1A, a block diagram of an embodiment of a compliant communication system 100-1 is shown. A compliant medium 124 or hydraulic line in this embodiment is connected to a reservoir 104 of hydraulic fluid. In one embodiment, the reservoir 104 might be at the surface of an oil well, the line 124 being used to operate a flow-valve deep underground. The reservoir 104 would therefore also be underground. A pump 108 can pump at a measured rate both into and out of the hydraulic line 124. There is a pressure sensor 112, measuring the pressure inside the hydraulic line 124.

Below surface there are one or more data devices 128 from which data is to be sent with a sub-surface transmitter 122. Each of sub-surface transmitter 122 is connected to a mechanism for intermittently blocking the hydraulic line 124, for example, a valve 116. The sub-surface transmitter 122 sends information from the data device 128 to the surface receiver. By opening and closing the valve 116, the sub-surface transmitter modulates the pressure on the hydraulic line 124. The pressure is read by the pressure sensor 112 and fed to the surface receiver 134 for decoding back into the information.

The pump 108 pumps hydraulic fluid in and out of the line 124. By biasing the fluid in the line 124, the constrained fluid is enhanced as a complaint medium. In one embodiment, the pump 108 would normally cycle between pumping a fixed volume in and then out again. The pumping is periodic. The data that the sub-surface transmitter sends is encoded into bits. A 2-level, 4-level, 8-level, etc. modulation scheme could be used. For example, in a 2-level modulation scheme zero or closed is used for one level and one or open is used for the other. For more than two modulation levels, the valve could be partially opened or closed. Positive or negative logic could be used along with an optional error correction scheme. More complicated modulation schemes such as NRZ (non-return zero) could be used in other embodiments.

Figure 1B:
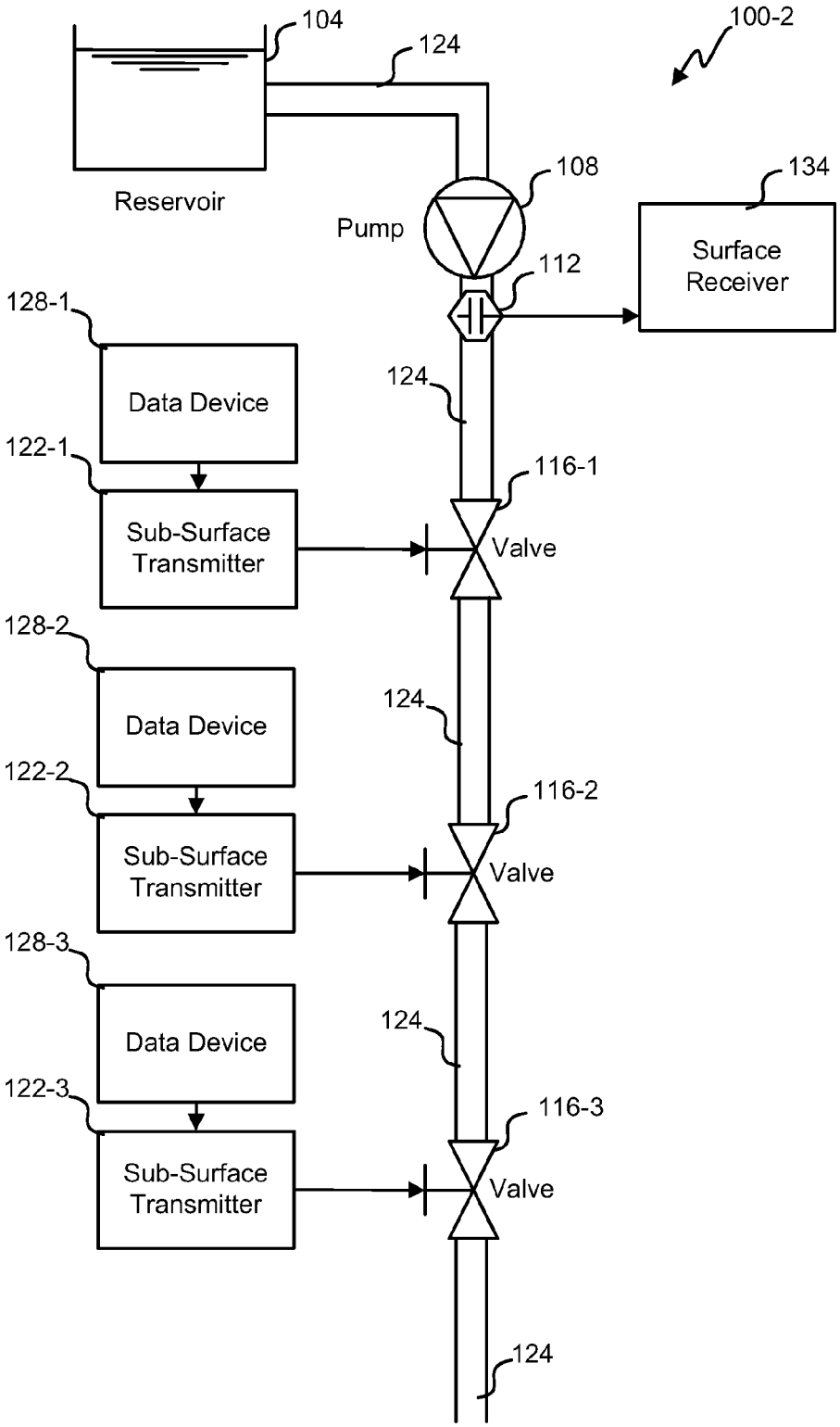

With reference to FIG. 1B, a block diagram of another embodiment of a compliant communication system 100-2 is shown. This embodiment has three different data devices 128, each with its own sub-surface transmitter 122 to modulate a different valve 116. At any given moment only one of the sub-surface transmitters 122 is modulating the compliant medium or line 124. For example, the first and third valves 116-1, 116-3 could be open, while the second valve 116-2 opens and closes to encode information onto the compliant medium 124.

Various schemes could be used to allow all the data devices 128 to use the compliant medium 124 for data transfer. For example, time-division could be used in one embodiment. The downhole equipment 122, 128 may either have a way to measure the line pressure to avoid transmissions from others or may be able to synchronize to the pump period. In the present embodiment, each data device tracks time and only transmits in a particular time slot. Another embodiment avoids time synchronization and randomly transmits information in the hope of avoiding overlap enough of the time to send an adequate amount of data for a given application.

Figure 1C:
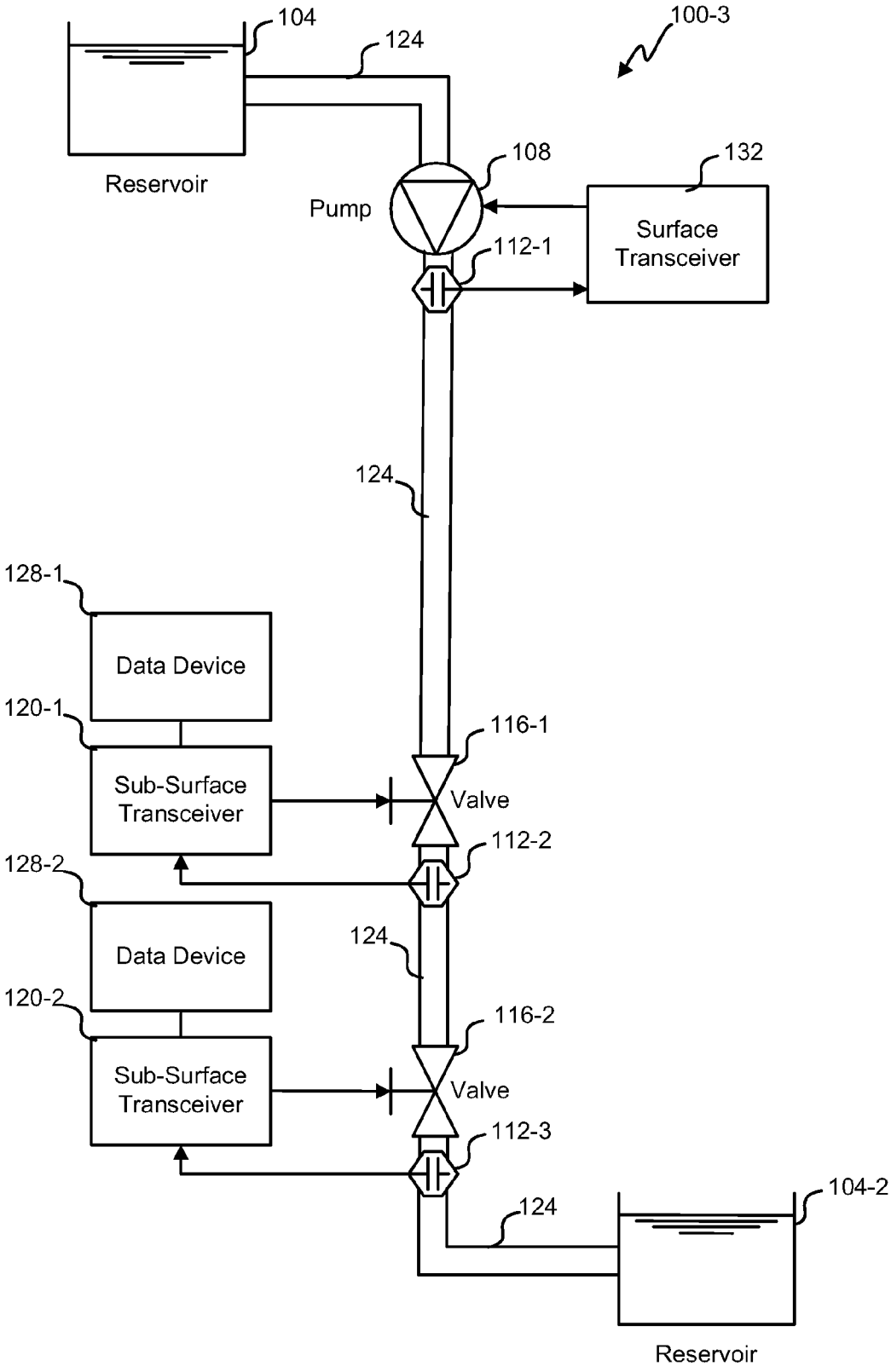

Referring next to FIG. 1C, a block diagram of yet another embodiment of a compliant communication system 100-3 is shown. This embodiment allows bi-directional communication. The pump 108 modulates the volume inserted or removed from the line 124. Each sub-surface transceiver 120 has a pressure sensor 112 to detect these changes in pressure. After decoding, that information is passed to the data device 128. The surface transceiver 132 can send information on the compliant medium 124 to set up time slots, poll the data devices 128, configure the data device and/or sub-surface transceiver, etc.

In order to transmit information from a data device 128, the valve 116 is opened and shut under the control of the sub-surface transceiver 120. In one embodiment, the opening and closing is synchronized with the pump 108. The pressure sensor 112 coupled to the sub-surface transceiver 120 allows actuating the valve 116 when there is generally the same volume of fluid in the line 124.

This embodiment includes a second reservoir 104-2 at the end of the line 124 proximate to the last sub-surface transceiver 120. For a data device 128-2 at the end of the line 124, the second reservoir 104-2 is used to enhance the difference in compliance between the valve 116-2 opening and closing.

Figure 1D:
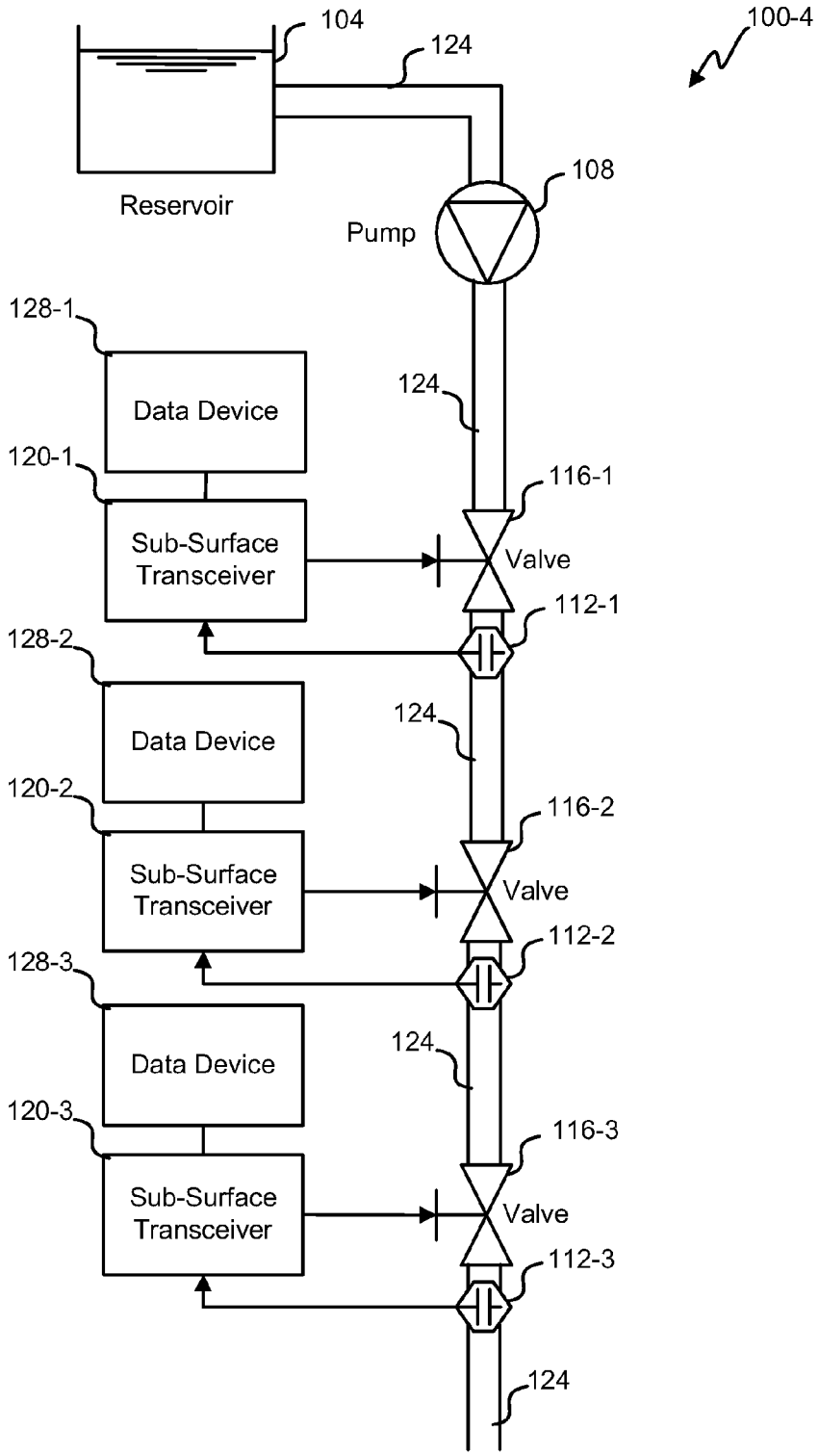

With reference to FIG. 1D, a block diagram of still another embodiment of a compliant communication system 100-4 is shown. This embodiment has three different data devices 128 where each has a pressure sensor 112 to enable bi-directional communication and/or time slot determination. The terminal data device 128 in this embodiment is not close to the end of the line 124 such that a second reservoir may not used as the terminal end of the line 124 provides a reservoir for the fluid.

This embodiment allows peer communication between the sub-surface transceivers 120. Each data device 128 could be addressed such that singlecast or multicast messaging could be done. A surface transceiver 132 could be used in other embodiments and still allow peer communication between the sub-surface transceivers 120.

Figure 1E:
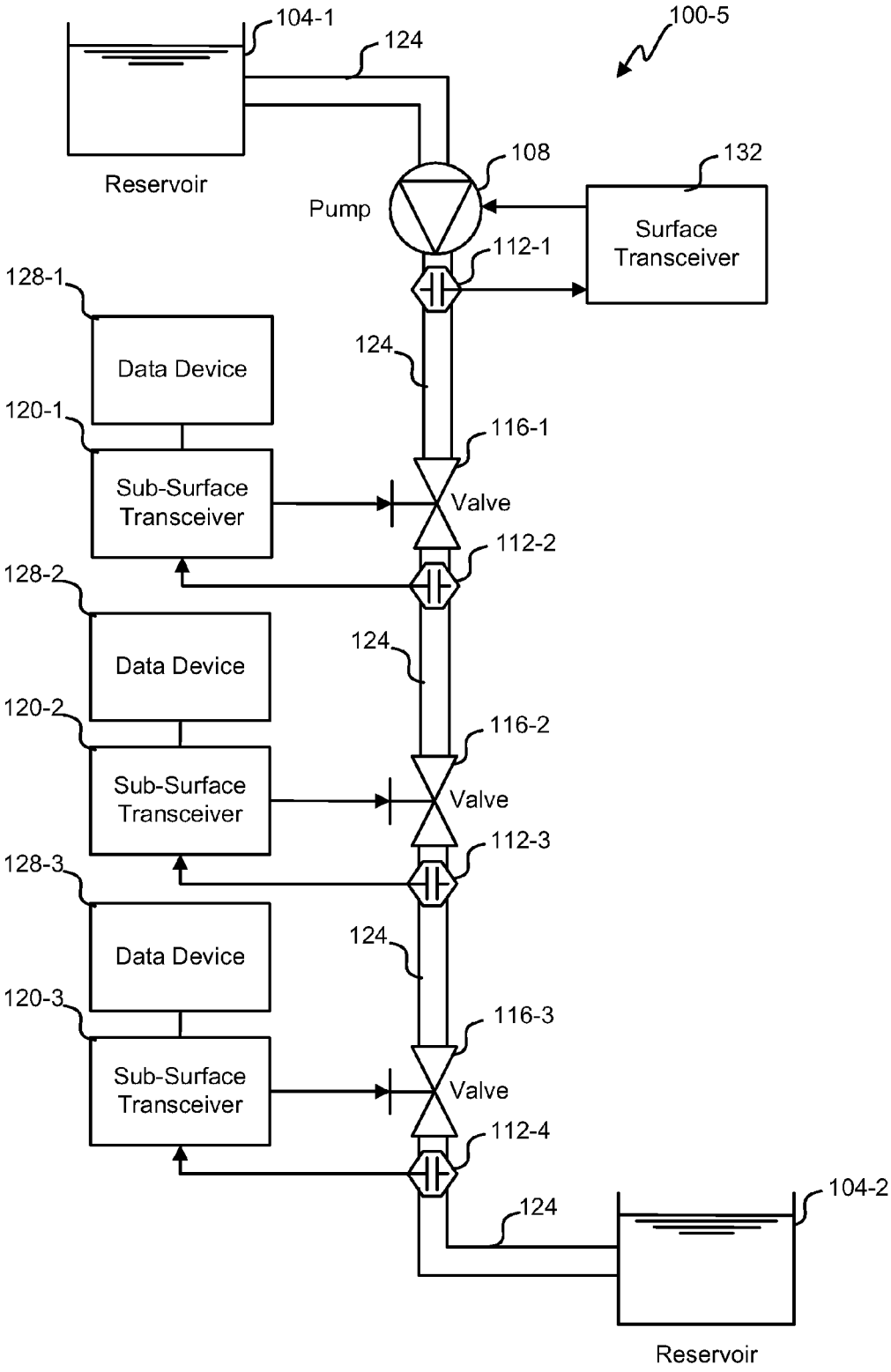

Referring next to FIG. 1E, a block diagram of another embodiment of a compliant communication system 100-5 is shown. This embodiment includes a second reservoir 104-2 at the terminal end of the line 124 to enhance compliance of the line for a valve 116 close to the terminal end of the line 124.

Figure 2:
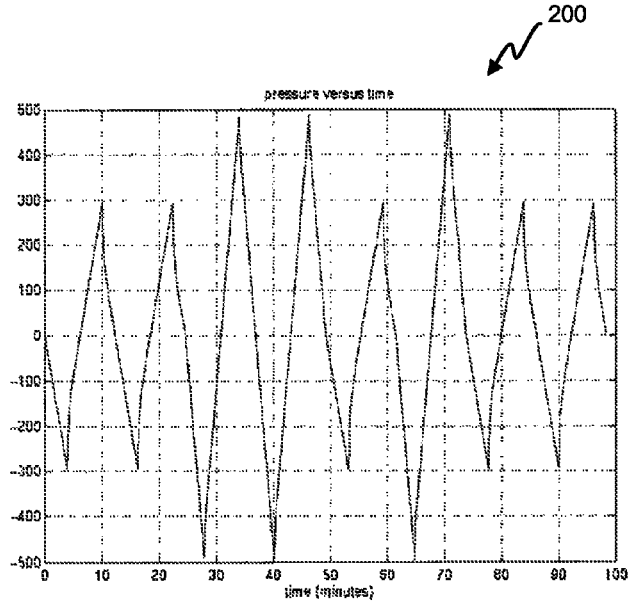
FIG. 2 depicts a chart of an example of pressure measured at a point of a compliant medium.

With reference to FIG. 2, a chart of an example 200 of pressure measured at a point of a compliant medium is shown. This figure shows the pressure measured at the sensor 112 over approximately one hundred minutes of operation. The pump cycle lasts for about twelve minutes in this example. If there were no fluid viscosity, the pressure would either rise or fall linearly with time, giving a triangular saw-tooth pattern. The viscous pressure, which is proportional to flow rate, results in an asymmetric shape to the teeth in the curve. The valve 116 is closed initially, then opening after two cycles, next shutting again after two cycles, opening again for the sixth cycle, and closing for the final two cycles. In a two-level modulation scheme this would be transmitting the binary digits 11001011.

Figure 3:
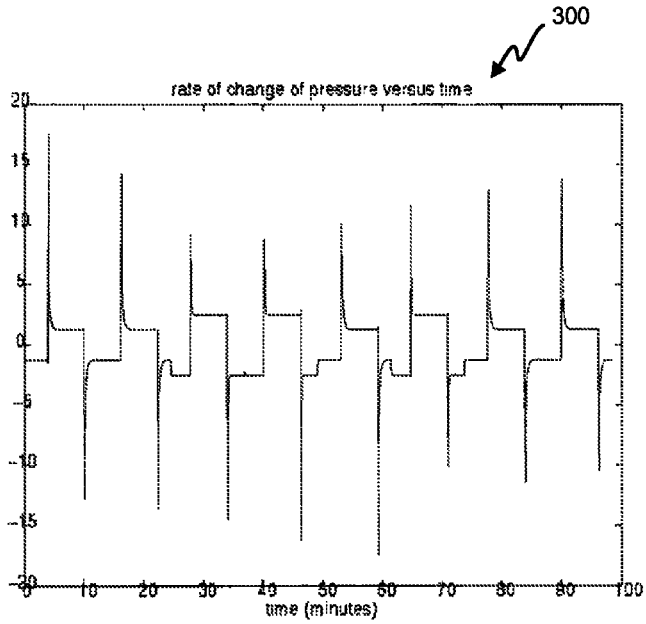
FIG. 3 depicts a chart of an example of a rate of pressure change over time.

Referring next to FIG. 3, a chart of an example 300 of a rate of pressure change over time is shown. In this example, there is a transient at each change in flow rate, but this is short compared to the bit length. The transient is longer when the valve is open (and hence the hydraulic line is longer). The characteristic time, T, of the system is given by the following formula:

$$T = \left(\frac{L}{r}\right)^2 \frac{\eta}{\kappa}$$

Where L is the length of the line, r is the radius, η is the viscosity, and κ is the bulk modulus of the hydraulic fluid possibly corrected for the compliance of the line wall. Typically, the characteristic time is from 10 s of seconds to minutes.

Figure 4:
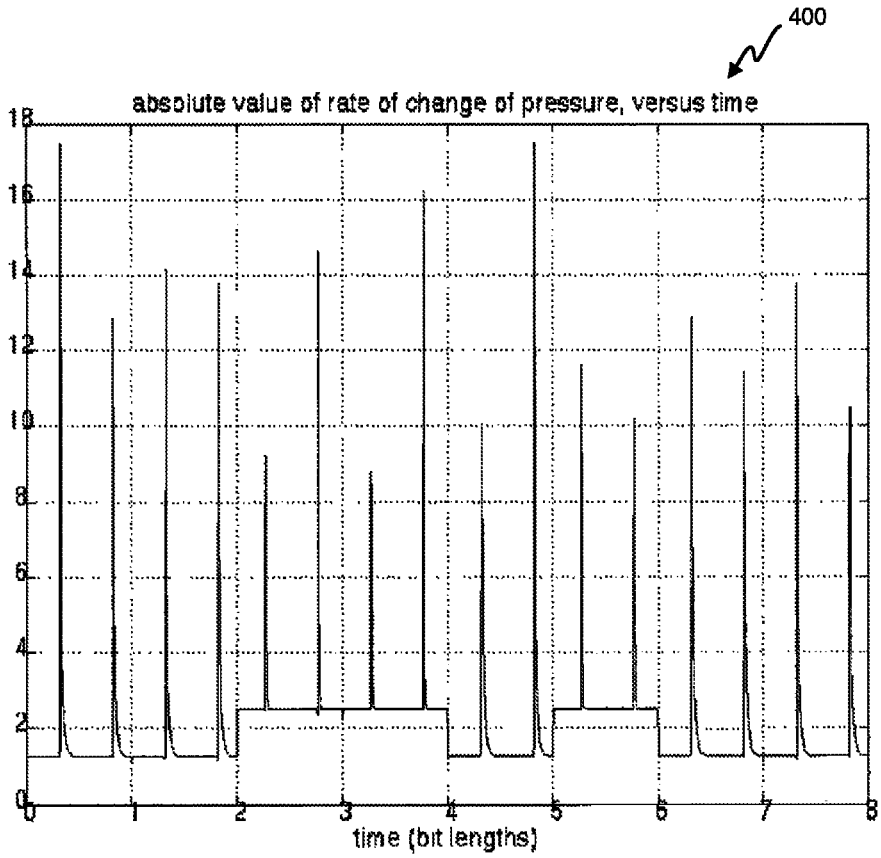
FIG. 4 depicts a chart of an example of an absolute value of the rate of pressure change over time.

With reference to FIG. 4, a chart of an example 400 of an absolute value of the rate of pressure change over time is shown. This figure shows the same data as FIG. 3, now normalized by the direction of flow, and with the time divided into bit times. The level changes can clearly be seen. If the bits are transmitted over at least one cycle (as shown), then instead of level being measured by rate of pressure change, it can be measured by using peak (or trough) pressures. Bits can be transmitted over less than one cycle, or asynchronously with the flow cycles, but has greater transients each time a valve opens or shuts, as the pressure may not be the same on each side of the valve. Some embodiments may filter the signal in the figure to remove the spikes.

Figure 5:
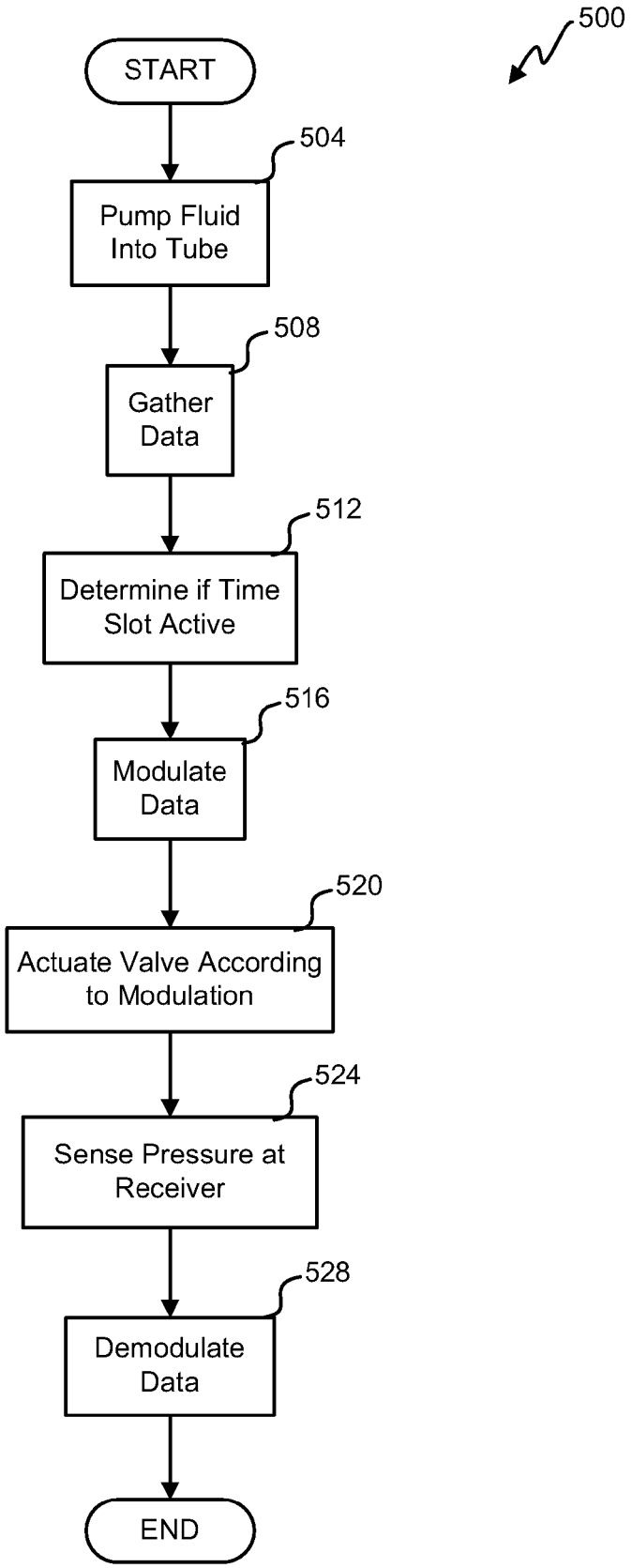
FIG. 5 illustrates a flowchart of an embodiment of a process for transmitting data using a compliant medium.

Referring next to FIG. 5, a flowchart of an embodiment of a process 500 for transmitting data using a compliant medium 124 is shown. The depicted portion of the process begins in step 504 where the tube or line has fluid pumped into it. This pumping happens continuously to bias the compliant medium 124. The data device 128 is gathering information in block 508. In block 512, a determination is made as to whether a time slot is available for sending information.

When a time slot is available, information is modulated in step 516. By actuating the valve 116 according to the data being sent in step 520 the complaint medium is given the information. The receiver 134 is coupled to a pressure sensor 112 that measures the pressure in step 512. With the pressure curve, the data is demodulated according to FIGS. 2-4 in step 528 to recover the data.

Figure 6:
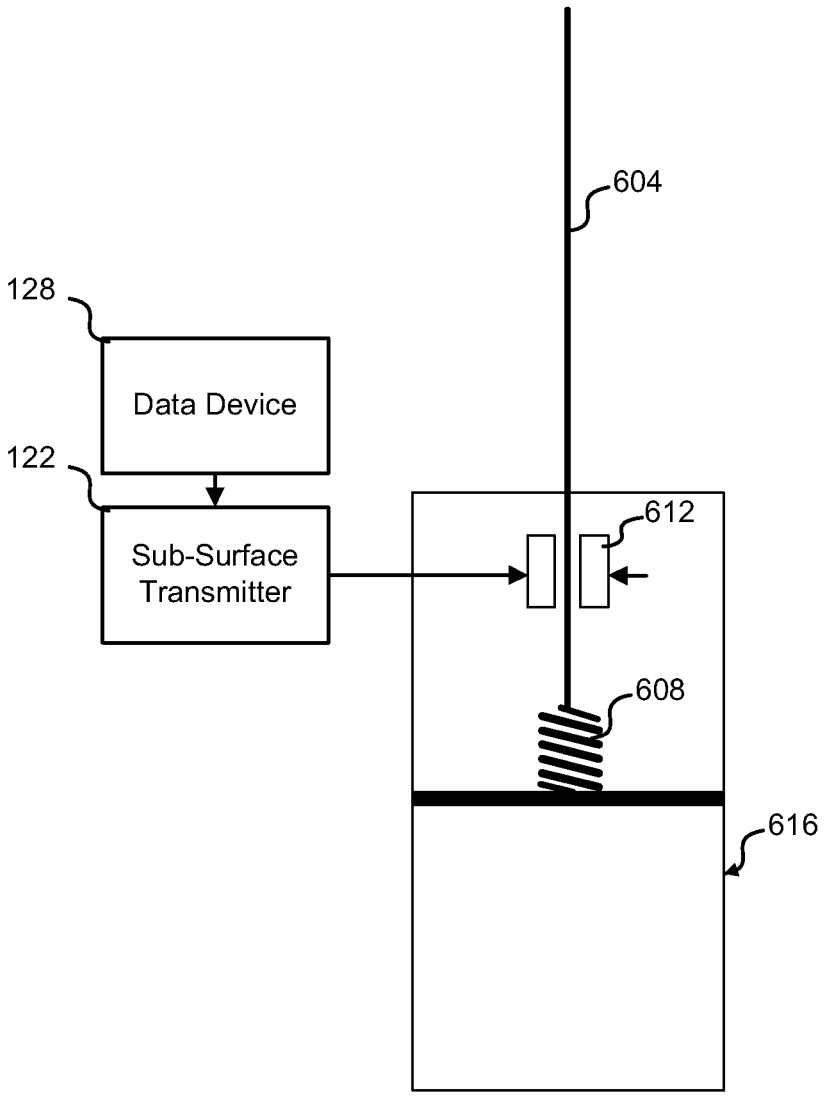
FIGS. 6 and 7 depict a block diagram of an embodiment a compliant communication system that uses a deployment wire as the compliant medium.
Figure 7:
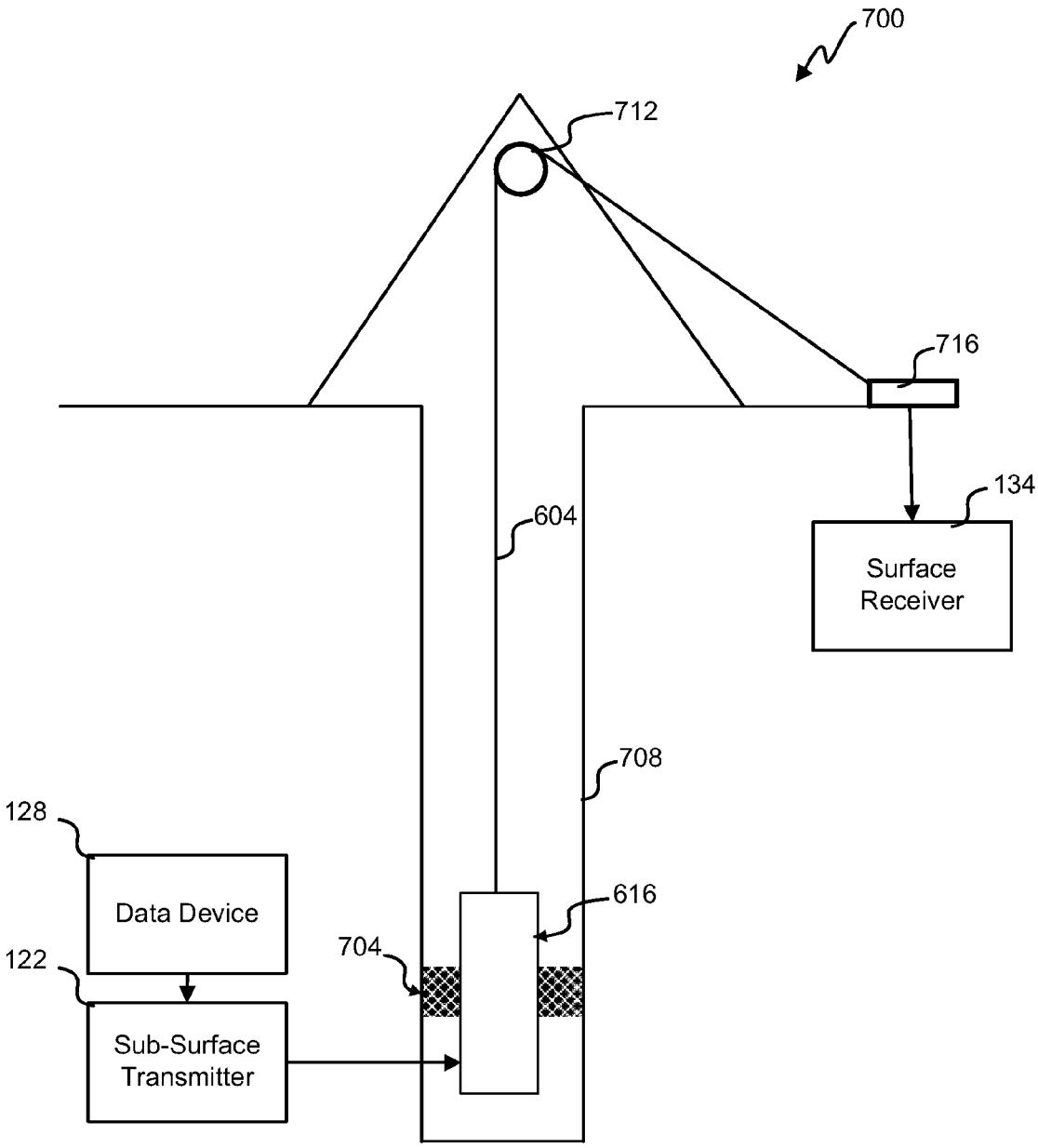

Referring next to FIGS. 6 and 7, another embodiment of a compliant communication system 700 is shown that uses a deployment wire 604 as the compliant medium. In this embodiment, a downhole tool 616 is installed in a borehole and connected to the surface by the deployment wire 604. The compliance of the system 700 is modified by the downhole tool 616.

The deployment wire 604 is attached to the downhole tool 616. A gripping arrangement is used to pinch the deployment wire 604, for instance hydraulic grippers 612 are used in this embodiment. The compliant medium or deployment wire 604 is biased with a spring 608 in this embodiment. When the grippers 612 are closed, the compliance of the wire 604 is defined by the compliance of the length of wire above the grippers 612. When the grippers 612 are opened, the additional compliance of the spring 608 is in series with the wire compliance, thus when the same force is applied to the deployment wire 604, a larger displacement is seen. The data device 128 uses a sub-surface transmitter 122 to modulate the grippers 612 to communicate information to the surface.

The downhole tool 616 is firmly attached to the borehole walls 708 by a mechanism such as a wireline-deployed packer 704. The deployment wire 604 joins the tool 616 to a surface winch and reel (not shown), via a pulley wheel 712 and a carrier mechanism 716 for pulling and releasing the deployment wire 604, within which the force-displacement characteristics of the wire deployment system can be measured and demodulated back into information by the surface receiver 134. The range of displacement of the carrier mechanism 716 is chosen so that the spring 608 will not be extended beyond the grippers 612.

The carrier mechanism 716 rhythmically or periodically pulls and releases the deployment wire 604, and measures the force versus displacement, i.e., the system compliance. In order to transmit data from the downhole tool 616 to surface, the grippers 612 are engaged and dis-engaged by the sub-surface transmitter 122 in order to modulate the compliance according to information produced by the data device 128. Other embodiments could have multiple downhole tools that use the same deployment wire to send information to the surface. Although this embodiment only sends information in one direction, other embodiments could use the carrier mechanism to send information to the downhole tool, allowing bidirectional communication.

A number of variations and modifications of the disclosed embodiments can also be used. For example, some of the above embodiments describe an application where there are portions of the system above ground and other portions below ground. In other embodiments, all the components could be above or below ground or underwater. Some of the above embodiments discuss the complaint medium being a hydraulic line, but other embodiments could be a tank of fluid, a pipeline, or a wire.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Implementation of the techniques, blocks, steps and means described above may be done in various ways. For example, these techniques, blocks, steps and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described above, and/or a combination thereof.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

While the principles of the disclosure have been described above in connection with specific apparatuses and methods, it is to be clearly understood that this description is made only by way of example and not as limitation on the scope of the disclosure.

What is claimed is:

1. A method for transmitting information with a compliant medium in a wellbore extending below ground from a surface location, the compliant medium comprising a wire extending from a first point which is at the surface to a second point which is below ground and onwards towards a termination below ground, the method comprising steps of:

biasing the wire, wherein the biasing is performed by applying tension to the wire at the first point which is at the surface;

intermittently gripping the wire at the second point which is below ground so as to restrain the wire at the second point against displacement by the applied tension, wherein:

the first point is distant from the second point, and the intermittent gripping modulates information onto the wire;

making measurements of one of a magnitude of displacement or a rate of displacement of the wire at the first point which is at the surface, in response to the applied tension, so as to observe changes in compliance of the wire resulting from the intermittent gripping of the wire at the second point, and recovering the information from the measurements.

2. The method for transmitting information with the compliant medium as recited in claim 1, further comprising a step of gathering the information below ground, away from the first point.

3. The method for transmitting information with the compliant medium as recited in claim 1, wherein the wire extends from the second point to a third point which is also below ground and extends from the third point onwards towards the termination, the method further comprising:

intermittently gripping the wire at the third point so as to restrain the wire at the third point against displacement by the applied tension to modulate second information onto the wire;

wherein the measurements of magnitude of displacement or rate of displacement of the wire at the first point also observe changes in compliance of the wire resulting from the intermittent gripping of the wire at the third point; and recovering the second information from the measurements.

4. The method for transmitting information with the compliant medium as recited in claim 3, wherein the intermittent gripping at the second and third points are time division multiplexed.

5. The method for transmitting information with the compliant medium as recited in claim 3, further comprising a step of determining if modulation of the wire corresponds with the second point or the third point.

6. The method for transmitting information with the compliant medium as recited in claim 1 wherein the wellbore is in production and the information comprises production information.

7. A method for communicating information with a compliant medium in a wellbore extending below ground from a surface location, the method comprising:

providing a constrained fluid confined within a fluid pathway extending from the surface location to a termination below ground, the constrained fluid being distributed along a length of fluid pathway having a first section extending from a first point which is at the surface to a second point which is below ground, wherein the first point is distant from the second point, and a second section extending from the second point to a third point which is also below ground and a third section of the fluid pathway extends from the third point onwards towards the termination;

cyclically pumping fluid into and out of the fluid pathway at the surface to raise and lower the pressure of the constrained fluid within the pathway during each cycle;

modulating connection of the sections of the fluid pathway at the second point according to information;

modulating connection of the second and third sections of the fluid pathway at the third point while maintaining connection of the first and second sections without modulation at the second point, the modulating at the third point changing between isolating and connecting the second and third sections according to second information;

making measurements of the pressure of the constrained fluid in the pathway with a fluid pressure sensor at the first point during individual cycles of variation of pressure so as to observe alterations of one of a magnitude of change and a rate of change of pressure of the constrained fluid in response to the raising and lowering of applied pressure and thereby observe changes in compliance of the constrained fluid resulting from modulating of connection at the second point and observe changes in compliance of the constrained fluid resulting from modulating of connection at the third point; and recovering the information from the measurements.

8. The method for communicating information with the compliant medium as recited in claim 7, wherein modulating connection of the sections of the fluid pathway at the second point is carried out by operating a valve at the second point.

9. The method for communicating information with the compliant medium as recited in claim 8, wherein modulating connection of the sections of the fluid pathway at the third point is carried out by operating a valve at the third point.

10. The method for communicating information with the compliant medium as recited in claim 7 wherein the wellbore is in production and the information comprises production information.

11. The method for communicating information with the compliant medium as recited in claim 7 wherein each cycle of raising and lowering pressure of the constrained fluid extends over a plurality of minutes.

* * * * *